US006299527B1

(12) United States Patent
Touchberry et al.

(10) Patent No.: US 6,299,527 B1
(45) Date of Patent: Oct. 9, 2001

(54) VENTILATION CONTROL SYSTEM FOR A BUILDING

(75) Inventors: Roger T. Touchberry, Willow Street; Daniel B. Truong, Lancaster, both of PA (US)

(73) Assignee: Val Products, Inc., Bird-in-Hand, PA (US)

( * ) Notice: Subject to any disclaimer, the term of this patent is extended or adjusted under 35 U.S.C. 154(b) by 0 days.

(21) Appl. No.: 09/541,163

(22) Filed: Mar. 31, 2000

(51) Int. Cl.[7] ..... F24F 13/00
(52) U.S. Cl. ..... 454/270; 137/271; 454/334
(58) Field of Search ..... 454/213, 270, 454/275, 303, 334, 358; 119/448; 137/271

(56) References Cited

U.S. PATENT DOCUMENTS 4,033,246 * 7/1977 Jentoft et al. ..... 454/358 X
5,145,460 * 9/1992 Smith, Jr. ..... 454/334 X
5,194,040 * 3/1993 Stoney ..... 454/334 X

FOREIGN PATENT DOCUMENTS

23897-A * 8/1901 (CH) ..... 454/334

* cited by examiner

*Primary Examiner*—Harold Joyce
(74) *Attorney, Agent, or Firm*—Dougherty & Troxell

(57) ABSTRACT

A ventilation control system is disclosed for a building having an elongated ceiling vent opening, the system having a vent door, spaced apart brackets pivotally supporting the door on the building structure adjacent to the ceiling vent opening such that the door is movable between closed and opened positions, and an actuating mechanism for moving the door between the closed and opened positions. The vent door has an elongated door casing of plastic material having a hollow interior and opposite side walls, a support member located in the hollow interior of the door casing adjacent to each of the opposite side walls and a foam material substantially filling the hollow interior of the door casing. The door casing may be extruded from plastic material and has integrally formed outwardly extending sealing members which engage the building structure when the vent door is in the closed position to seal the vent opening. The support members have connecting portions extending from one end of the door casing to facilitate connecting a plurality of doors together in end-to-end abutting relationship.

26 Claims, 6 Drawing Sheets

FIG. 5
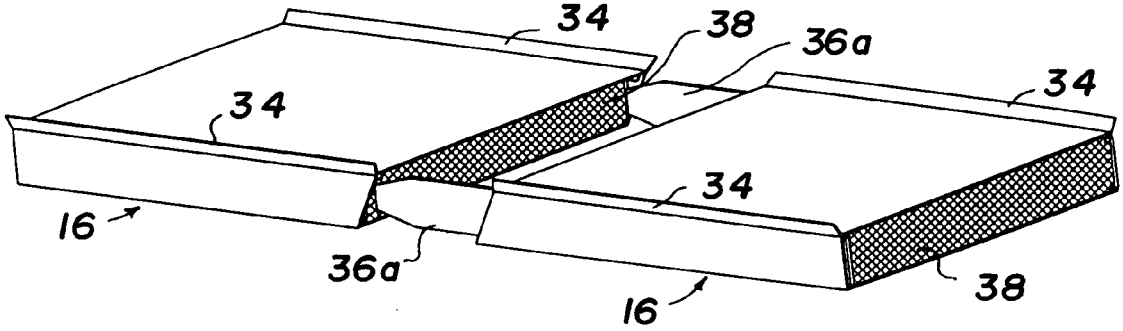
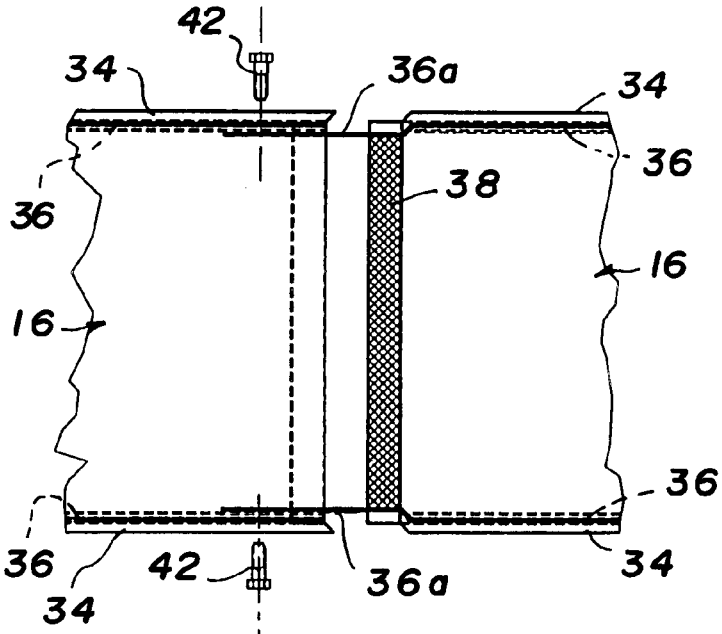
FIG. 6
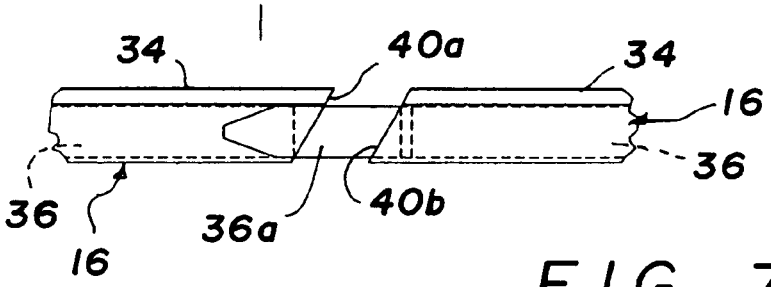
FIG. 7

VENTILATION CONTROL SYSTEM FOR A BUILDING

BACKGROUND OF THE INVENTION

The present invention relates to a ventilation control system for an elongated ceiling vent in a building, more particularly such a system including a vent door having a construction enabling a plurality of doors to be abutted together to enable the ventilation system to control virtually any length of ceiling vent opening.

Ventilation systems for farm buildings, factories and other work places may have an elongated ceiling vent opening to provide communication between the interior of the building and the ambient atmosphere to provide proper ventilation for the building. The known systems also include some type of door or damper to open or close the vent opening to regulate flow of air through the vent opening and, hence, the ventilation of the building.

In farm buildings, such as layer houses, the ventilation must be accurately controlled to provide the proper atmosphere within the building to maximize the egg production. Layer houses typically may be between 200 and 600 feet in length and have a plurality of vent openings in the ceiling each running the length of the building. The ceiling vent openings along with the associated doors or dampers are usually located in relatively inaccessible locations in the upper ceiling of the building. Thus, it is desirable for such a ventilation control system utilized in these surroundings to demonstrate reliable performance, since maintenance is difficult and time consuming. The location puts a premium on the reliability of such systems, since they are usually inaccessible for routine maintenance.

The known ventilation control systems include metal doors pivotally attached to the building structure adjacent to the ceiling vent opening and connected to an actuating system to move the doors between opened and closed positions. Due to the significant length of the ceiling vent openings, the weight of the metal doors requires a substantial connection to the building structure and requires a powerful actuator to move the door between the opened and closed positions. While such doors are well known, they have not proven to be entirely successful. The metal doors and the pivot attachments will corrode and rust over time, rendering them inoperative.

Another known system slidably attaches the door to inclined supports on each side of the door. To move the door between the opened and closed position, the actuator pulls the door along the inclined supports. Quite obviously, the friction generated between the doors and the inclined supports will increase over time, given the difficulty of providing routine lubrication and maintenance to the ventilation system. Again, this known type of ventilation control has not proven to be entirely reliable.

Thus, it is believed that a ventilation control system including lightweight doors fabricated from non-corroding and non-rusting materials would provide a significant benefit to the users of such ventilation control systems.

SUMMARY OF THE INVENTION

A ventilation control system is disclosed for a building having an elongated ceiling vent opening, the system having a vent door, spaced apart brackets pivotally supporting the door on the building structure adjacent to the ceiling vent opening such that the door is movable between closed and opened positions, and an actuating mechanism for moving the door between the closed and opened positions. The vent door has an elongated door casing of plastic material having a hollow interior and opposite side walls, a support member located in the hollow interior of the door casing adjacent to each of the opposite side walls and a foam material substantially filling the hollow interior of the door casing. The door casing may be extruded from plastic material and has integrally formed sealing members extending outwardly which engage the building structure when the vent door is in the closed position to seal the vent opening. The support members may have connecting portions extending from one end of the door casing to facilitate connecting a plurality of doors together in end-to-end abutting relationship. Alternatively, separate splicing strips may be inserted into the abutting ends to hold the doors together. This enables the doors to be fabricated in standard lengths and the required number of doors affixed together to accommodate the length of the vent opening in a particular building. The vent door rests on a plurality of U-shaped support members which are pivotally connected to the building structure and are also connected to the actuator such that pivoting motion of these support members moves the door between the opened and closed positions.

BRIEF DESCRIPTION OF THE DRAWINGS

FIG. 5 is a partial, perspective view illustrating the connection of two vent doors according to the present invention.

FIG. 6 is a partial, plan view of the doors illustrated in FIG. 5.

FIG. 7 is a partial, side view of the doors illustrated in FIG. 6.

DETAILED DESCRIPTION OF THE PREFERRED EMBODIMENT

Figure 1:
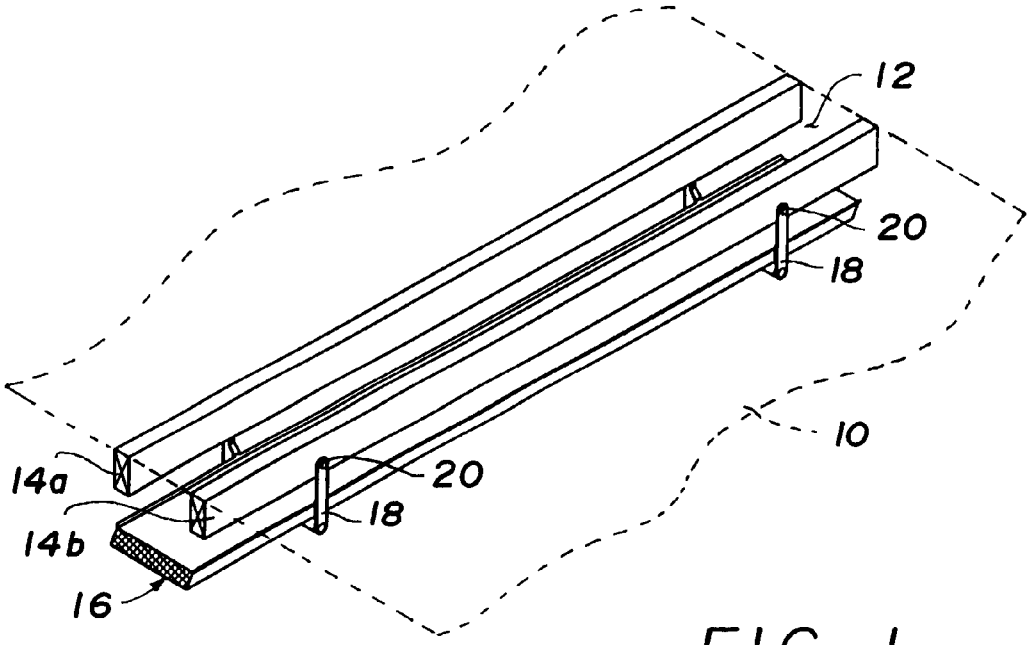
FIG. 1 is a perspective view of the ventilation control system according to the present invention.
Figure 2:
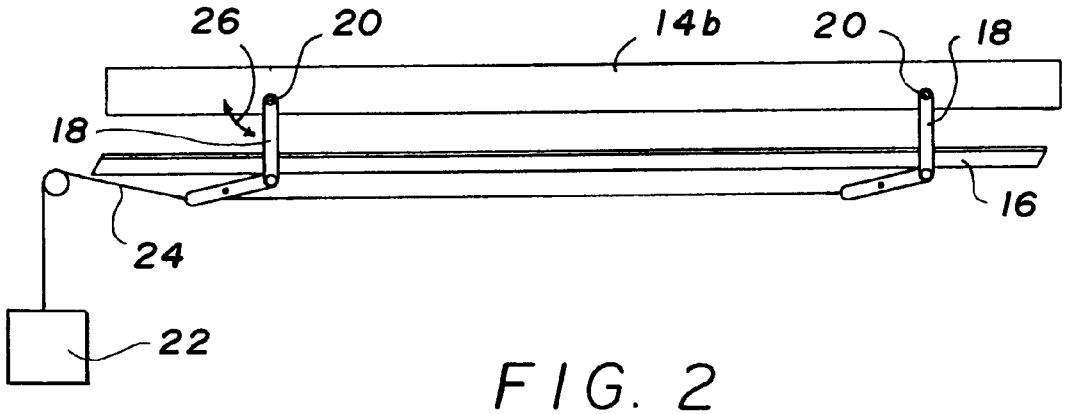
FIG. 2 is a side view of the ventilation control system illustrated in FIG. 1.
Figure 3:
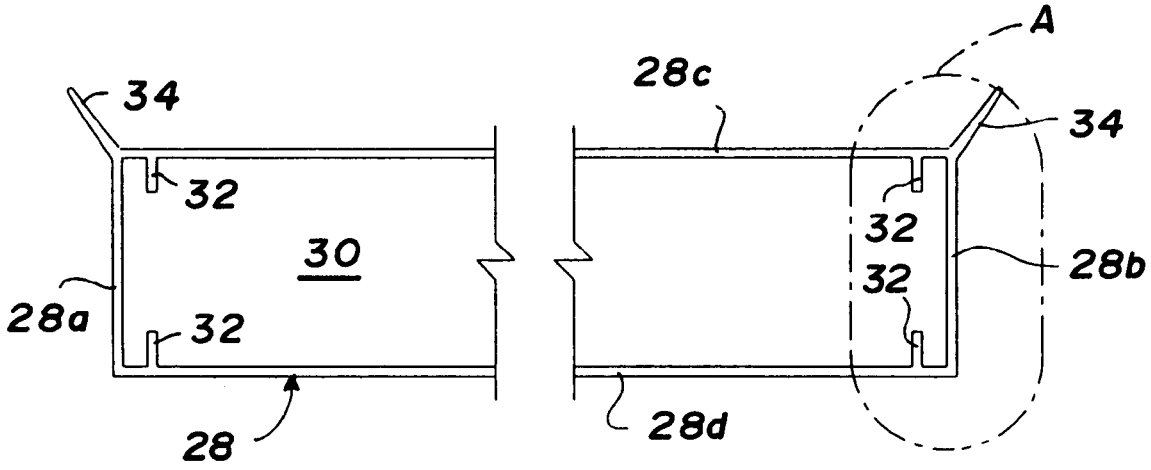
FIG. 3 is a cross-sectional view of the door casing utilized with the vent door according to the present invention.
Figure 4:
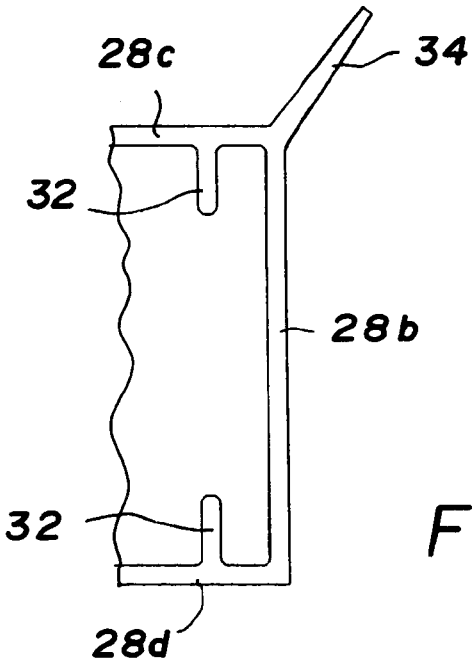
FIG. 4 is a partial, enlarged view of area A in FIG. 3.
Figure 10:
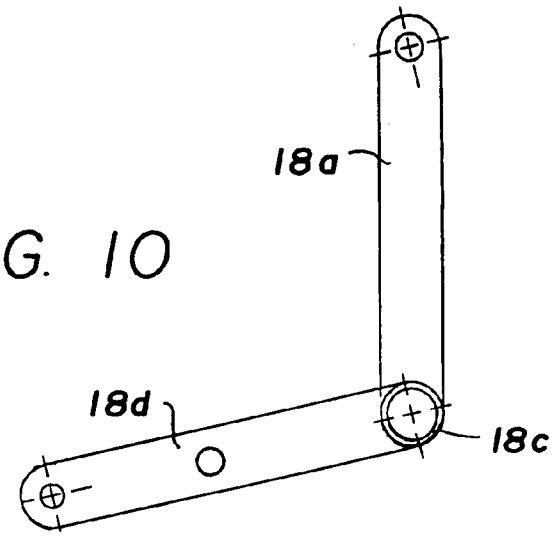
FIG. 10 is a cross-sectional view of the support bracket taken along line X—X in FIG. 15.

The ventilation control system according to the present invention is illustrated in FIGS. 1 and 2 in association with the ceiling 10 of a building (not shown) which has a ceiling vent opening 12 bounded on either side by beams 14*a* and 14*b*. Although ceiling vent opening 12 in FIG. 1 is illustrated as being generally of the same length as the vent door 16, it is to be understood that ceiling vent opening 12 may extend along the entire length of a building, which may be on the order of 200–600 feet. As will be described in more detail hereinafter, a plurality of doors 16 may be affixed together in abutting, end-to-end relationship along the entire length of the ceiling vent opening 12.

Figure 15:
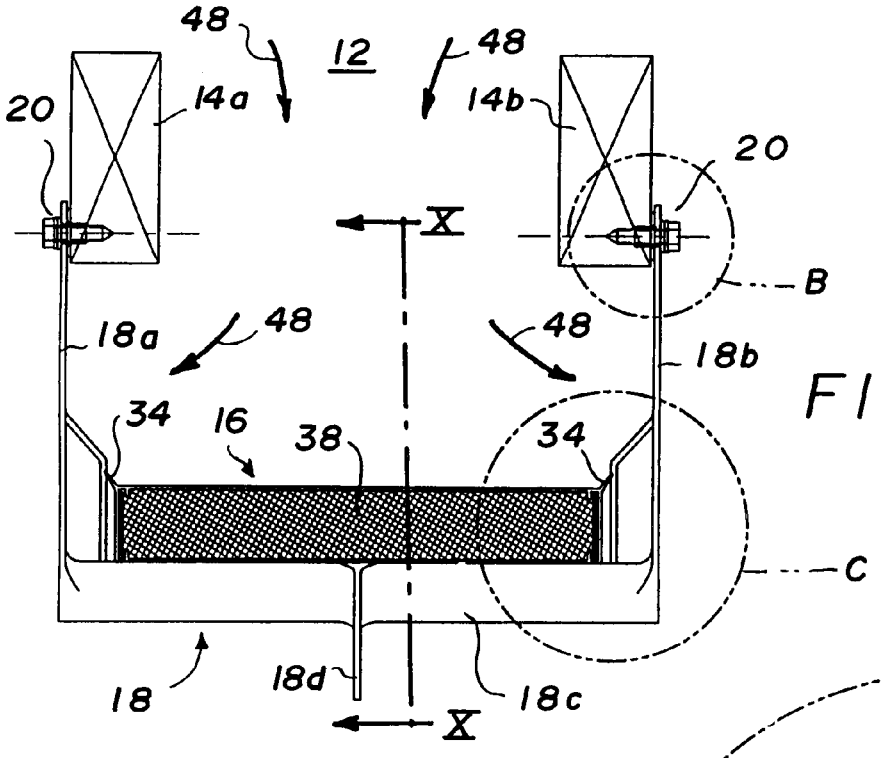
FIG. 15 is an end view of the ventilation control assembly illustrated in FIG. 2.
Figure 17:
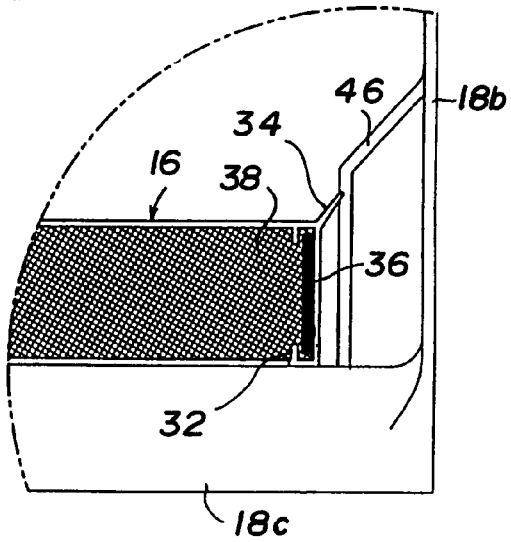
FIG. 17 is a partial, enlarged view of area C in FIG. 15.

A plurality of spaced-apart support brackets 18 having generally U-shaped configurations (as best illustrated in FIG. 15) are pivotally connected to the beams 14*a* and 14*b* by pivot connections 20. The brackets 18 are also connecting to actuator 22 via actuating element 24 which may be a cable, chain or rope. The actuator 22 may be any known type of actuator, such as a manually operable crank, motor driven drum, or hydraulic type actuator, as are well known in the art. By pulling on the flexible actuating element 24, the brackets 18 are caused to pivot about pivot connections 20 in the direction of arrow 26 to move the door 16 between an opened position illustrated in FIGS. 1 and 2, and a closed position in which an upper surface of the door 16 contacts the bottom surfaces of the beams 14*a* and 14*b* so as to close the ceiling vent opening 12. As is well known in the art, the actuator 22 may also include sensors to sense various atmospheric parameters within the building enclosure and may automatically control the opening and closing of the door 16 to maintain the desired interior atmospheric conditions.

The vent door 16 includes an elongated door casing 28 formed of a material having non-corroding and non-rusting characteristics, such as a polyvinylchloride (PVC) plastic material. The door casing 28 may be formed by an extrusion process and may be subsequently cut to predetermine the lengths as desired. Although any lengths of door casings may be utilized, it is envisioned that standardized lengths, such as 10' may be utilized, with the doors being connected together in abutting, end-to-end relationship with a length sufficient to cover the entire length of the ceiling vent opening. The vent door casing 28 bounds a hollow interior 30 which extends along the entire length of the vent door casing 28. Vent door casing 28 may also include opposite side walls 28*a* and 28*b*, as well as upper and lower walls 28*c* and 28*d*.

Locating tabs 32 extend inwardly into the hollow interior 30 from the top and bottom walls 28*c* and 28*d*, respectively, and are located adjacent to, but spaced from, opposite side walls 28*a* and 28*b*. The spaces between the side walls and the locating tabs accommodate the support members, as will be described in more detail hereinafter.

Sealing members 34 extend outwardly from an upper portion of the vent door casing 28 and are extruded integrally with the vent door casing. As noted above, the vent door casing 28 may be formed of a rigid PVC plastic material. However, the sealing members 34 should exhibit some degree of flexibility, since they bear against the lower portion of the ceiling 10 or the beams 14*a*, 14*b* when the vent door 16 is in the closed position in order to seal the vent opening 12. Depending upon the specific structure of the building around the vent opening 12, the sealing members 34 may extend obliquely outwardly from opposite upper corners of the vent door casing 28 and may extend along the entire length of the casing.

Figure 8:
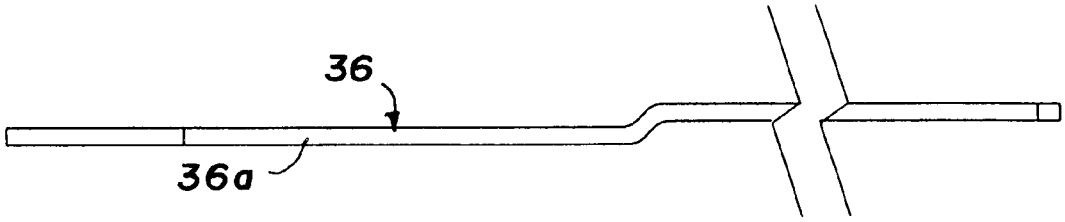
FIG. 8 is a top view of a support member utilized in the vent door of FIG. 5.
Figure 9:
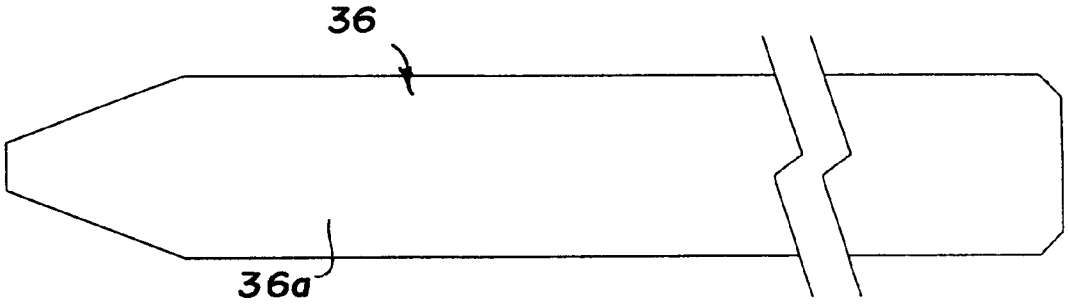
FIG. 9 is a side view of the support member illustrated in FIG. 8.
Figure 11:
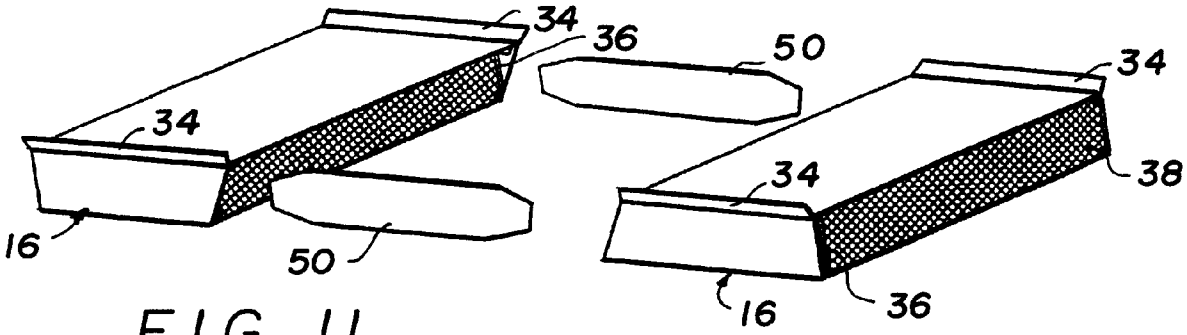
FIG. 11 is a partial, perspective view illustrating a second embodiment of the connection of two vent doors.
Figure 13:
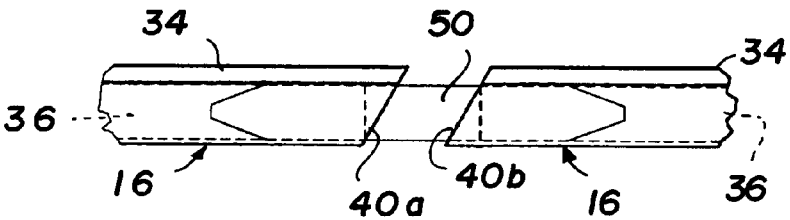
FIG. 13 is a partial, side view of the embodiment of FIG. 11.

Support members 36 are formed of rigid material, such as aluminum, and have a length substantially equal to the length of the vent door casing 28. The support members 36 are inserted into the space between the opposite side walls 28*b* and the adjacent locating tabs 32 by sliding the support members 36 through an end of the vent door casing 28. If the vent door 16 is to be connected to other vent doors, the support members, as illustrated in FIGS. 8 and 9, may have a connecting portion 36*a* which extends outwardly beyond one end of the vent door casing 28, best seen in FIGS. 5–7. The connecting portion 36*a* is laterally offset with respect to the remainder of the support member 36, as illustrated in FIG. 8. The distal end of the connecting portion 36*a* may be tapered to facilitate insertion of the connecting portion 36*a* into an adjacent vent door 16.

Once the support members 36 have been inserted into the vent door casing 28 adjacent to the opposite sides 28*a* and 28*b*, the hollow material 30 is filled with a foamed in place rigid foam material. The locating tabs 32 hold the support members 36 in place adjacent to the opposite sides of the casing during the foaming process. The foam is preferably a rigid polyurethane foam material, but may be any known type of rigid foam material which will provide the requisite rigidity to the vent door 16, without adding significant weight. The foam material is illustrated at 38 in FIG. 5. The expansion of the foam within the casing 28 as it cures and rigidifies urges the foam into the space between the opposite side walls 28*a* and 28*b* of the vent door casing 28 and the locating tabs 32 to securely hold the support members 36 in place.

A plurality of the vent doors 16 may be attached together in abutting, end-to-end relationship as illustrated in FIGS. 5–7. The opposite ends of each of the vent doors 16 are beveled as at 40*a* and 40*b*, the opposite ends being beveled in the same direction such that they are generally parallel to each other. As noted previously, one end of the vent door 16 has connecting portions 36*a* extending therefrom. The connecting portions 36*a* are inserted into an end of an adjacent vent door 16 until the beveled ends 40*a* and 40*b* are in abutting relationship. The offset of the connecting portions 36*a*, as best illustrated in FIG. 6, enable the connecting portions 36*a* to enter the foam 38 adjacent to the ends of the support members 36 in the adjacent vent door 16. The connecting portions 36*a* may be forcibly inserted into the rigid foam 38, or openings in the foam 38 may be formed before such insertion. Once the adjacent vent doors 16 are in abutting relationship, fasteners 42, such as self tapping screws, are inserted laterally into the vent door 16 adjacent to the juncture such that the fastener passes through the side of the door casing, the support member of one vent door and through the connecting portion 36*a* of the adjacent vent door. Any number of vent doors 16 may be interconnected together in order that the entire length of the ceiling vent opening 12 may be controlled.

Figure 14:
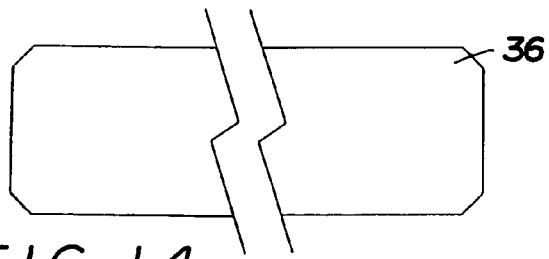
FIG. 14 is a side view of a second embodiment of the support member according to the present invention.
Figure 12:
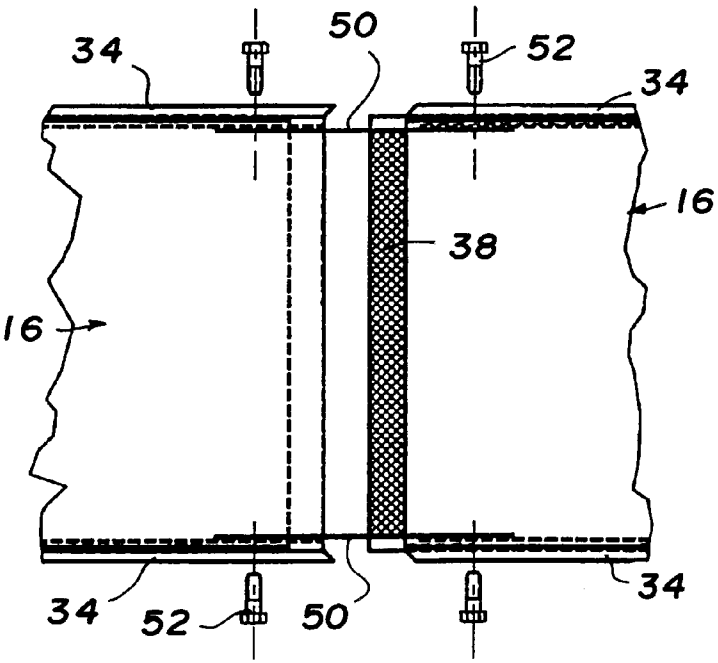
FIG. 12 is a partial, plan view of the embodiment of FIG. 11.

Instead of forming the support members 36 with connecting portions 36*a* extending from one end of the door, separate splicing strips 50 may be inserted into each of the adjacent ends to hold the doors 16 together. This embodiment is illustrated in FIGS. 11–14. As seen therein, splicing strips 50 are formed of aluminum, or other metallic, strip material having a substantially constant thickness and have opposite beveled end portions to facilitate their insertion into the ends of the doors 16. Openings may be formed in the foam 38 adjacent to the support members 36, or the ends of the splicing strips 50 may be forcibly inserted into the foam adjacent to the support members 36. In this embodiment, the support members 36 are configured as illustrated in FIG. 14 with the opposite end portions terminating inwardly of the opposite ends of the door casing 28. This embodiment facilitates the shaping and finishing of the beveled end portions 40*a* and 40*b*, since the ends of the support members 36 do not protrude beyond the beveled ends.

Once the splicing strips 50 have been inserted into the doors 16, and the beveled ends 40*a* and 40*b* have been brought into abutting relationship, fasteners 52 are inserted laterally through the side wall of the casing 28, the adjacent support member 36 and the splicing strip 50. This secures the adjacent doors together and enables the length of the door to be varied to accommodate the desired length of vent opening.

Figure 16:
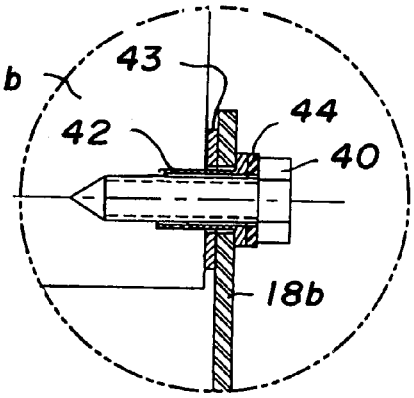
FIG. 16 is a partial, enlarged view of area B in FIG. 15.

As best seen in FIG. 15, each of the spaced apart brackets 18 has a generally U-shaped configuration with upstanding opposite arms 18*a* and 18*b* interconnected at their bottom ends by cross member 18*c*. The distal ends of members 18*a* and 18*b* are pivotally connected to one of the beams 14*a* or 14*b* by pivot connection 20, illustrated in more detail in FIG. 16. Each pivot connection 20 may comprise a threaded screw 40 inserted through a plastic, such as nylon, bushing 42 with shad washers 43 and 44 inserted between the bracket 18 and the associated beam 14, as well as between the head of the threaded screw 40 and an outer end of the plastic bushing 42. Extending obliquely downwardly from the cross member 18*c* is connecting member 18*d* that is connected to the flexible actuating element 24, as illustrated in FIG. 2.

The vent door 16 is placed onto the cross members 18*c* of the plurality of brackets 18 and is laterally positioned between the members 18*a* and 18*b* by positioning members 46 which extend laterally inwardly from each of the members 18*a* and 18*b*.

When the vent door 16 is in the open position, as illustrated in FIG. 15, air will enter the ceiling vent opening 12 and pass laterally outwardly between the vent door 16 and the beams 14*a* and 14*b*, as indicated by arrows 48. When the vent door 16 is moved to the closed position, the sealing elements 34 will bear against the lower portions of the beams 14*a* and 14*b* to thereby close the ceiling vent opening 12.

As can be seen, the ventilation control system according to the present invention includes a vent door fabricated from materials which will not corrode or rust, and materials which are rigid, but also light in weight. The low weight facilities ease of operation of the ventilation system, while the materials minimize the maintenance required during the lifetime of the system, thereby inherently increasing its reliability.

The foregoing description is provided for illustrative purposes only and should not be construed as in any way limiting this invention, the scope of which is defined solely by the appended claims.

We claim:

1. A vent door for an elongated ceiling vent in a building, comprising:

a) an elongated door casing having a hollow interior and opposite side walls;

b) a support member located in the hollow interior of the door casing adjacent to each of the opposite side walls; and, c) a foam material located in and substantially filling the hollow interior of the door casing.

2. The vent door of claim 1 wherein the support members extend substantially along an entire length of the door casing.

3. The vent door of claim 1 wherein at least one of the support members has a connecting portion extending outwardly from an end of the door casing.

4. The vent door of claim 3 wherein the connecting portion is laterally offset with respect to the remainder of the at least one support member.

5. The vent door of claim 1 wherein the support members each have a connecting portion extending outwardly from an end of the door casing.

6. The vent door of claim 5 wherein the connecting portions are laterally offset with respect to the remainder of the associated support member.

7. The vent door of claim 1 wherein the door casing has top and bottom walls and further comprising locating tabs extending into the hollow interior from at least one of the top and bottom walls adjacent to and spaced from each of the opposite side walls, whereby the support members are located between one of the locating tabs and the adjacent side wall.

8. The vent door of claim 7 wherein the locating tabs extend into the hollow interior from both the top and bottom walls.

9. The vent door of claim 1 further comprising flexible sealing members located on and extending outwardly from the door casing.

10. The vent door of claim 9 wherein the flexible sealing members are integrally formed with the door casing.

11. The vent door of claim 10 wherein the door casing and the flexible sealing members are formed of polyvinylchloride (PVC) plastic material.

12. The vent door of claim 1 wherein the foam material comprises a rigid polyurethane material.

13. A ventilation control system for a building having an elongated ceiling vent opening, the system comprising:

a) at least one vent door comprising:

i) an elongated door casing having a hollow interior and opposite side walls;

ii) a support member located in the hollow interior of the door casing adjacent to each of the opposite side walls; and, iii) a foam material located in and substantially filling the hollow interior of the door casing;

b) at least two spaced apart brackets, each bracket being pivotally connected to the building and supporting the at least one vent door such that the at least one vent door is movable between a closed position, wherein the at least one vent door covers the ceiling vent opening, and an opened position, wherein the at least one vent door is displaced away from the ceiling vent opening; and c) an actuating mechanism for moving the at least one vent door between the closed and opened positions.

14. The ventilation control system of claim 13 wherein the actuating mechanism includes an elongated, flexible actuating element connected to the brackets.

15. The ventilation control system of claim 13 wherein each bracket comprises spaced apart bracket arms connected at one end by a bracket cross-member in a substantially U-shaped configuration, wherein the at least one vent door is supported by the bracket cross-members.

16. The ventilation system of claim 13 further comprising a plurality of vent doors disposed in abutting end-to-end relationship.

17. The ventilation system of claim 16 further comprising at least one connection device to connect together the abutting vent doors.

18. The ventilation system of claim 17 wherein the at least one connection device comprises a connecting portion on at least one support member extending outwardly from one of the abutting vent doors and into the interior of another of the abutting vent doors.

19. The ventilation system of claim 18 further comprising a fastener extending through a sidewall of one of the plurality of vent doors and the connecting portion of the support members of the abutting vent door.

20. The ventilation system of claim 17 wherein the at least one connection device comprises at least one splicing strip having a first end inserted into one of two abutting vent doors, and a second end inserted into the other of the two abutting vent doors.

21. The ventilation system of claim 20 further comprising a plurality of splicing strips inserted into adjacent ends of two abutting vent doors.

22. The ventilation system of claim 20 wherein the at least one splicing strip is located adjacent to the support member and further comprising a fastener extending through the support member and the adjacent splicing strip.

23. The ventilation system of claim 13 further comprising flexible sealing members located on and extending outwardly from the door casing so as to contact a portion of the building when the at least one vent door is in the closed position to seal the elongated ceiling vent opening.

24. The vent door of claim 23 wherein the flexible sealing members are integrally formed with the door casing.

25. The vent door of claim 24 wherein the door casing and the flexible sealing members are formed of polyvinylchloride (PVC) plastic material.

26. The vent door of claim 13 wherein the foam material comprises a rigid polyurethane material.

* * * * *